US008465300B2

(12) United States Patent
Lin

(10) Patent No.: US 8,465,300 B2
(45) Date of Patent: Jun. 18, 2013

(54) CABLE INSTALLATION ASSEMBLY

(75) Inventor: Chih-Cheng Lin, New Taipei (TW)

(73) Assignee: Primesource Telecom Inc., New Taipei (TW)

( * ) Notice: Subject to any disclaimer, the term of this patent is extended or adjusted under 35 U.S.C. 154(b) by 78 days.

(21) Appl. No.: 13/232,914

(22) Filed: Sep. 14, 2011

(65) Prior Publication Data

US 2013/0065409 A1 Mar. 14, 2013

(51) Int. Cl.
*H01R 4/66* (2006.01)

(52) U.S. Cl.
USPC ..... 439/101

(58) Field of Classification Search
USPC ..... 439/101, 92, 924.1, 589, 682
See application file for complete search history.

(56) References Cited

U.S. PATENT DOCUMENTS

| | | | | | |
|---|---|---|---|---|---|
| 1,742,312 | A | * | 1/1930 | Hagel | 439/462 |
| 2,312,002 | A | * | 2/1943 | Schmitt | 200/51.1 |
| 2,386,177 | A | * | 10/1945 | Andersen | 439/294 |
| 2,563,712 | A | * | 8/1951 | Frei et al. | 439/279 |
| 2,700,140 | A | * | 1/1955 | Phillips | 439/274 |
| 2,722,667 | A | * | 11/1955 | Huston | 439/279 |
| 2,882,509 | A | * | 4/1959 | Archer et al. | 439/289 |
| 3,076,168 | A | * | 1/1963 | Keen | 439/279 |
| 3,115,380 | A | * | 12/1963 | Kuehl et al. | 439/201 |
| 3,125,395 | A | * | 3/1964 | Swanson | 439/660 |
| 3,157,450 | A | * | 11/1964 | Harrison, Sr. et al. | 439/275 |
| 3,404,364 | A | * | 10/1968 | Paullus et al. | 439/458 |
| 3,432,795 | A | * | 3/1969 | Jayne | 439/60 |
| 3,441,898 | A | * | 4/1969 | Nils | 439/289 |
| 3,600,670 | A | * | 8/1971 | Senour et al. | 323/367 |
| 3,633,147 | A | * | 1/1972 | Polidori | 439/279 |
| 3,944,915 | A | * | 3/1976 | Yonce | 324/504 |
| 3,945,700 | A | * | 3/1976 | Didier | 439/589 |
| 3,970,352 | A | * | 7/1976 | Dorrell et al. | 439/595 |
| 3,992,652 | A | * | 11/1976 | Blaisdell et al. | 361/118 |
| 4,152,826 | A | * | 5/1979 | Mueller | 29/828 |
| 4,193,655 | A | * | 3/1980 | Herrmann, Jr. | 439/166 |
| 4,245,875 | A | * | 1/1981 | Shaffer et al. | 439/144 |
| 4,253,717 | A | * | 3/1981 | Stewart | 439/101 |
| 4,281,887 | A | * | 8/1981 | Luca, Jr. | 439/449 |
| 4,364,626 | A | * | 12/1982 | Price | 439/680 |
| 4,576,430 | A | * | 3/1986 | Dufresne | 439/429 |
| 4,705,481 | A | * | 11/1987 | Pritchard | 439/417 |
| 4,756,593 | A | * | 7/1988 | Koakutsu et al. | 385/139 |
| 4,820,204 | A | * | 4/1989 | Batty | 439/681 |
| 4,867,692 | A | * | 9/1989 | Kerek | 439/101 |
| 4,927,374 | A | * | 5/1990 | Batty | 439/310 |
| 5,481,939 | A | * | 1/1996 | Bernardini | 74/502.4 |
| 5,490,789 | A | * | 2/1996 | Simons | 439/101 |

(Continued)

*Primary Examiner* — Briggitte R Hammond
*Assistant Examiner* — Vladimir Imas
(74) *Attorney, Agent, or Firm* — Chun-Ming Shih; HDLS IPR Services

(57) ABSTRACT

A cable installation assembly includes a connector, a power wire, a ground wire and two signal wires. The connector includes a base, having a plurality of terminal containing grooves formed in the base and arranged separately adjacent to each other. The power wire includes a power core and a power terminal electrically coupled to power core, and each power terminal is plugged into each corresponding terminal containing groove. The ground wire includes a grounding core and a grounding terminal electrically coupled to the grounding core and plugged into the terminal containing groove. The signal wire includes a signal core and a signal terminal electrically coupled to signal core, and the two signal terminals are plugged into the terminal containing grooves respectively and not arranged adjacent to each other, so that signals can be transmitted without interfering with one another.

11 Claims, 5 Drawing Sheets

U.S. PATENT DOCUMENTS 5,491,766 A * 2/1996 Huynh et al. ..... 385/100
5,863,221 A * 1/1999 Castaldo ..... 439/589
6,027,349 A * 2/2000 Chang ..... 439/101
6,095,871 A * 8/2000 Zahora et al. ..... 439/695
6,814,632 B1 * 11/2004 Peterson ..... 439/877
7,744,383 B2 * 6/2010 Da Silva ..... 439/92
7,744,414 B2 * 6/2010 Scherer et al. ..... 439/607.05
8,192,232 B2 * 6/2012 Whiteman et al. ..... 439/620.01

* cited by examiner

CABLE INSTALLATION ASSEMBLY

FIELD OF THE INVENTION

The present invention relates to a cable structure, in particular to a cable installation assembly.

BACKGROUND OF THE INVENTION

As technology advances and information network blooms, our life has been changed significantly, and most networks require a cable or an optical fiber to transmit signals, and the quality of the cable structure affects the speed and quality of signal transmissions, so that the inventor of the present invention attempts to provide an improved innovative cable structure.

A conventional cable generally includes a power wire, a ground wire and a signal wire. After the power wire and signal wire are attached with each other, an insulation layer is formed and covered onto the wires by an injection molding process, and the power wire, the ground wire and the signal wire are combined together, and a connector is provided for connecting ends of the power wire, the ground wire and the signal wire to form a cable structure.

However, the power wire, the ground wire and the signal wire of the conventional cable structure are combined by attaching with one another. Since the signal wire is a high-frequency electric signal, which will affect the transmission of other different low-frequency electric signals, and each signal wire is not installed in a regular form, the electric signals of each signal wire will interfere with one another and affect the quality of signal transmissions.

In view of the foregoing problem, the inventor of the present invention conducted extensive researches and experiments, and finally provided a feasible design to overcome the aforementioned problem.

SUMMARY OF THE INVENTION

Therefore, the present invention is to provide a cable installation assembly that separates the signal terminals from one another and performs signal transmissions without interfering with one another.

The present invention provides a cable installation assembly, comprising a connector, a plurality of power wires, a ground wire and two signal wires. The connector includes a base, and a plurality of terminal containing grooves formed in the base and arranged separately adjacent to each other. Each power wire includes a power core and a power terminal electrically coupled to the power core, and each power terminal is plugged into the corresponding terminal containing groove. The ground wire includes a grounding core and a grounding terminal electrically coupled to the grounding core, and the grounding terminal is also plugged into the terminal containing groove. Each signal wire includes a signal core and a signal terminal electrically coupled to the signal core, and the two signal terminals are plugged into the terminal containing grooves respectively and not arranged adjacent to each other.

The present invention further has the following effects. The grounding terminal is installed between the two signal terminals, so that the two signal terminals also have the effects of providing good isolation and shielding. The power wire, the ground wire and the signal wire are wrapped independently to prevent inferences between each other due to the frequency difference, so as to improve the transmission quality of the cable installation assembly.

DESCRIPTION OF THE PREFERRED EMBODIMENTS

The technical characteristics and contents of the present invention will become apparent with the following detailed description and related drawings. The drawings are provided for the purpose of illustrating the present invention only, but not intended for limiting the scope of the invention.

Figure 1:
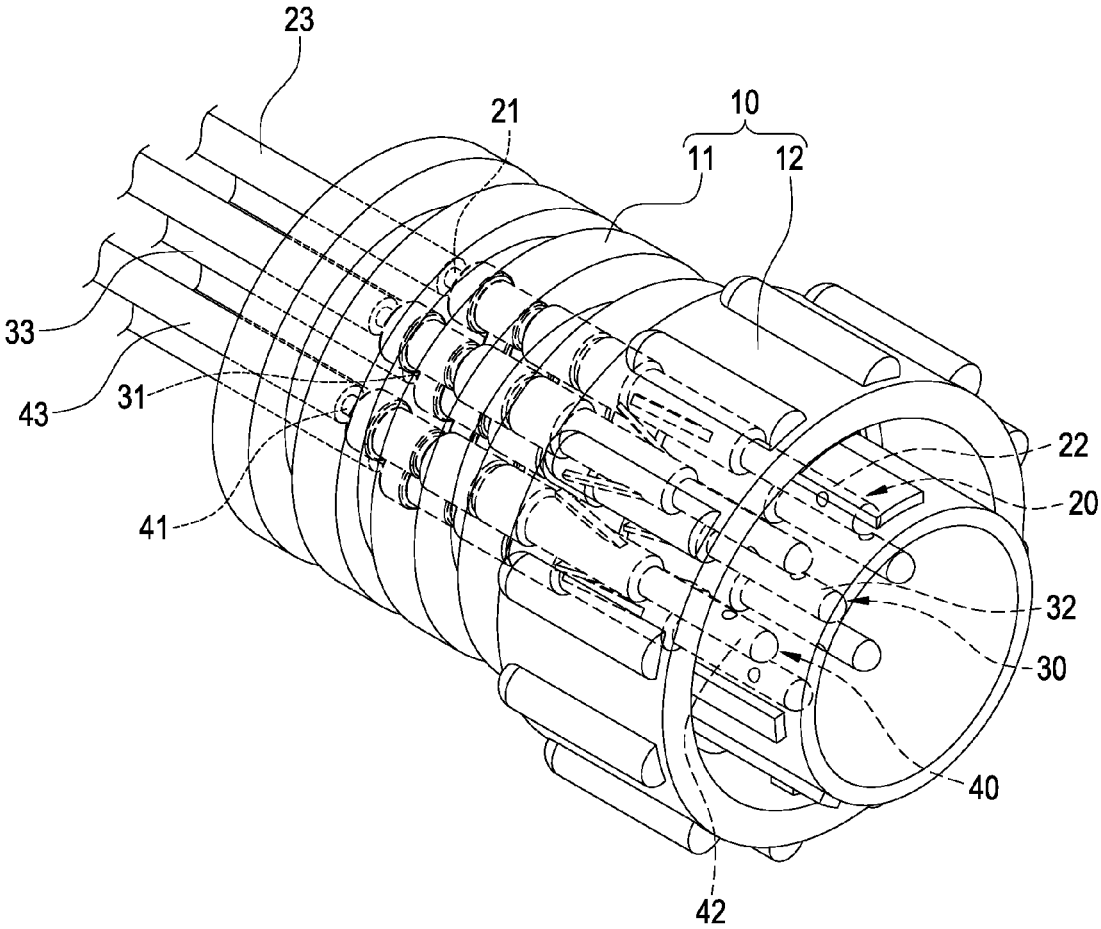
FIG. 1 is a perspective view of a cable installation assembly in accordance with the present invention.
Figure 2:
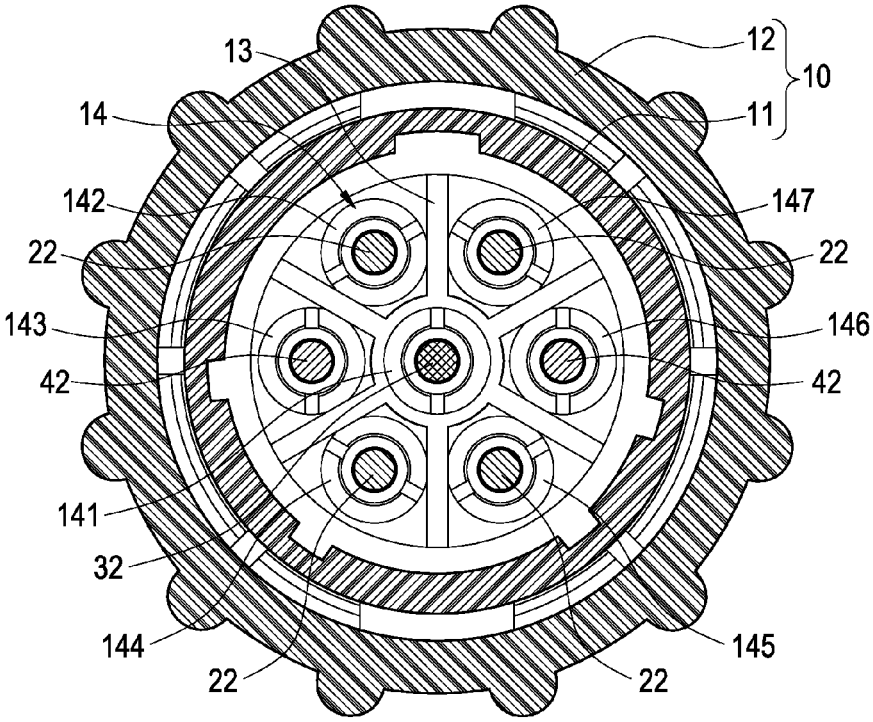
FIG. 2 is a cross-sectional view of a cable installation assembly in accordance with the present invention.

With reference to FIGS. 1 and 2 for a cable installation assembly in accordance with a preferred embodiment of the present invention, the cable installation assembly comprises a connector 10, four power wires 20, a ground wire 30 and two signal wires 40.

The connector 10 is made of an insulating material such as plastic, the connector 10 is comprised of a hollow cylindrical base 11 and a knob 12 coupled to an end of the cylindrical base 11. The base 11 includes a plurality of partitions 13 installed therein for separating the plurality of terminal containing grooves 14 from one another. In this preferred embodiment, there are seven terminal containing grooves 14, but the invention is not limited to this configuration only. The terminal containing grooves 14 include a first slot 141 arranged at the center, and a second slot to a seventh slot 142, 143, 144, 145, 146, 147 arranged into a circular shape by using the first slot 141 as the center of the circle.

Each power wire 20 comprises a power core 21 and a power terminal 22 electrically coupled to the power core 21, wherein the power core 21 can be a copper wire, and the power terminal 22 can be a male connector in this preferred embodiment. Each power terminal 22 is plugged into the second slot 142, fourth slot 144, fifth slot 145 and seventh slot 147 of the terminal containing groove 14 separately. Each power core 21 has an insulation layer 23 covered onto an external surface of the power core 21, wherein the insulation layer 23 is made of polyethylene (PE), polyvinyl chloride (PVC), polypropylene (PP) or flame resistant polyethylene (FRPE). In the four power wires 20, there are two fire wires and two ground wires, wherein the two fire wires are separated from one another by the two ground wires and are not arranged adjacent to one another. In this preferred embodiment, the power terminals 22 of the two fire wires are disposed in the second slot 142 and the fifth slot 145 respectively, and the power terminals 22 of the two ground wires are disposed in the fourth slot 144 and the seventh slot 147 respectively.

The ground wire 30 includes a grounding core 31 and a grounding terminal 32 electrically coupled to the grounding core 31, wherein the grounding core 31 is a copper wire, and the grounding terminal 32 is a male connector, and the grounding terminal 32 is plugged into the first slot 141 of the terminal containing groove 14 in this preferred embodiment. In addition, an insulation layer 33 is covered onto an external surface of the grounding core 31, wherein the insulation layer 33 is made of polyethylene, polyvinyl chloride, polypropylene or flame resistant polyethylene.

Each signal wire 40 includes a signal core 41 and a signal terminal 42 electrically coupled to the signal core 41, wherein the signal core 41 is a copper wire, and the signal terminal 42 is a male connector in this preferred embodiment, wherein the signal terminal 42 is plugged into the third slot 143 of the terminal containing groove 14, and another signal terminal 42 is plugged into the sixth slot 146 of the terminal containing groove 14, and the two signal terminals 42 are not arranged adjacent to one another. In addition, an insulation layer 43 is covered onto an external surface of the signal core 41, wherein the insulation layer 43 is also made of polyethylene, polyvinyl chloride, polypropylene or flame resistant polyethylene (FRPE).

Figure 3:
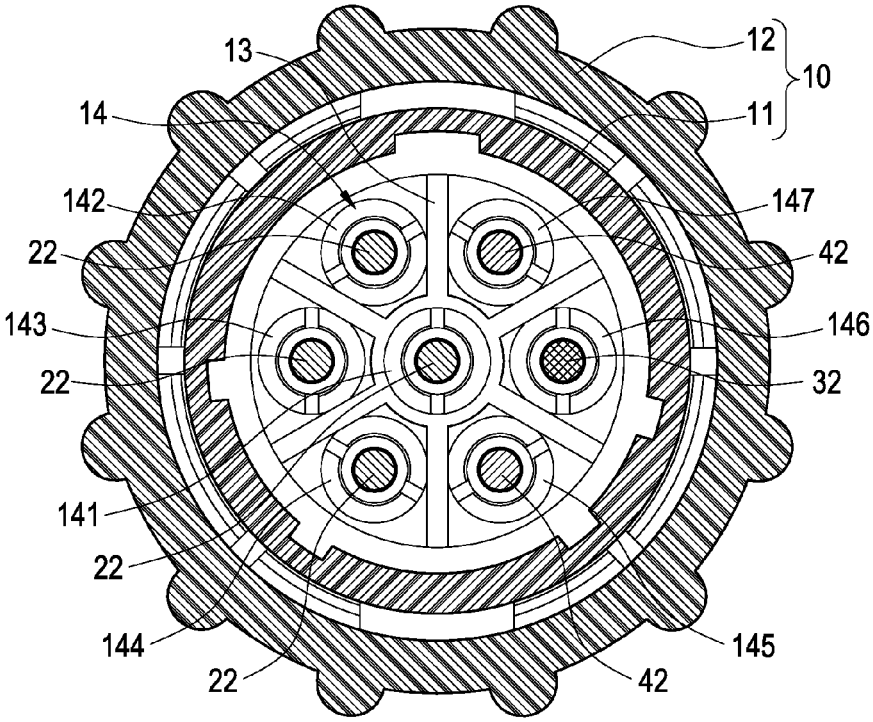
FIG. 3 is cross-sectional view of another preferred embodiment of the present invention.

With reference to FIG. 3 for a cable installation assembly of another preferred embodiment of the present invention, each power terminal 22 is plugged into the first slot 141, second slot 142, third slot 143, fourth slot 144 of the terminal containing groove 14 separately. The grounding terminal 32 is plugged into the sixth slot 146 of the terminal containing groove 14, wherein one signal terminal 42 is plugged into the fifth slot 145 of the terminal containing groove 14, and the other signal terminal 42 is plugged into the seventh slot 147 of the terminal containing groove 14, and the two signal terminals 42 are not arranged adjacent to each other. In this preferred embodiment, the power terminals 22 of the two fire wires are disposed in the second slot 142 and the fourth slot 144 respectively, and the power terminals 22 of the two ground wires are disposed in the first slot 141 and the third slot 143 respectively.

Figure 4:
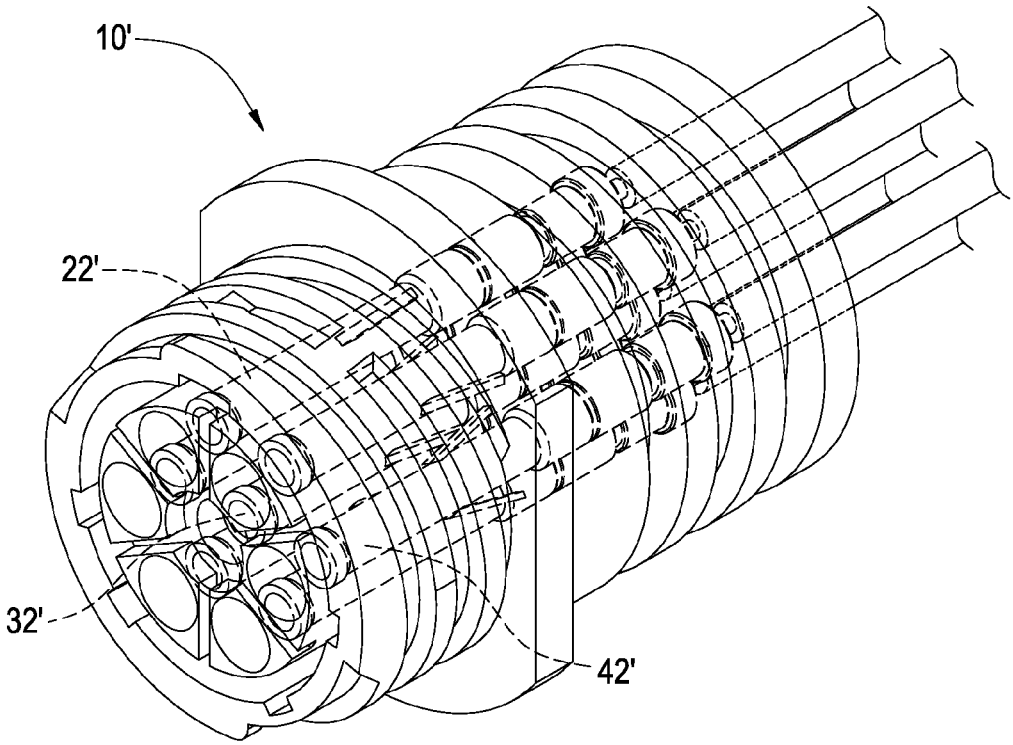
FIG. 4 is a perspective view of a further preferred embodiment of the present invention.
Figure 5:
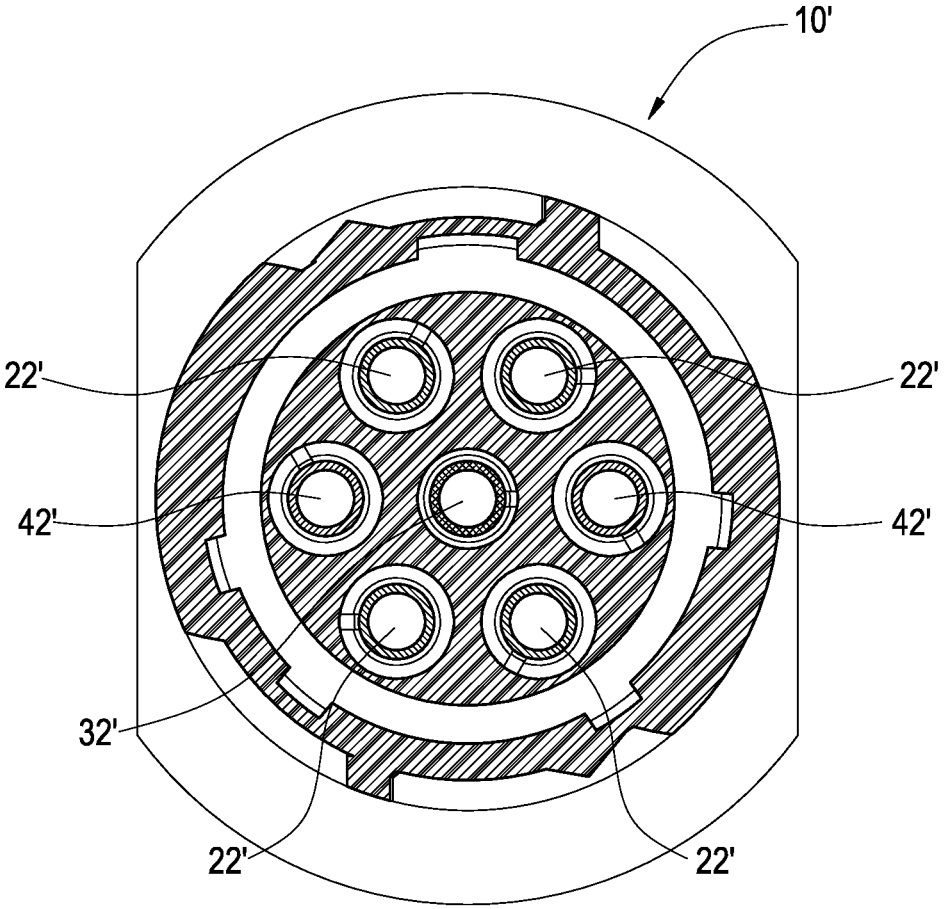
FIG. 5 is a cross-sectional view of a further preferred embodiment of the present invention.
Figure 6:
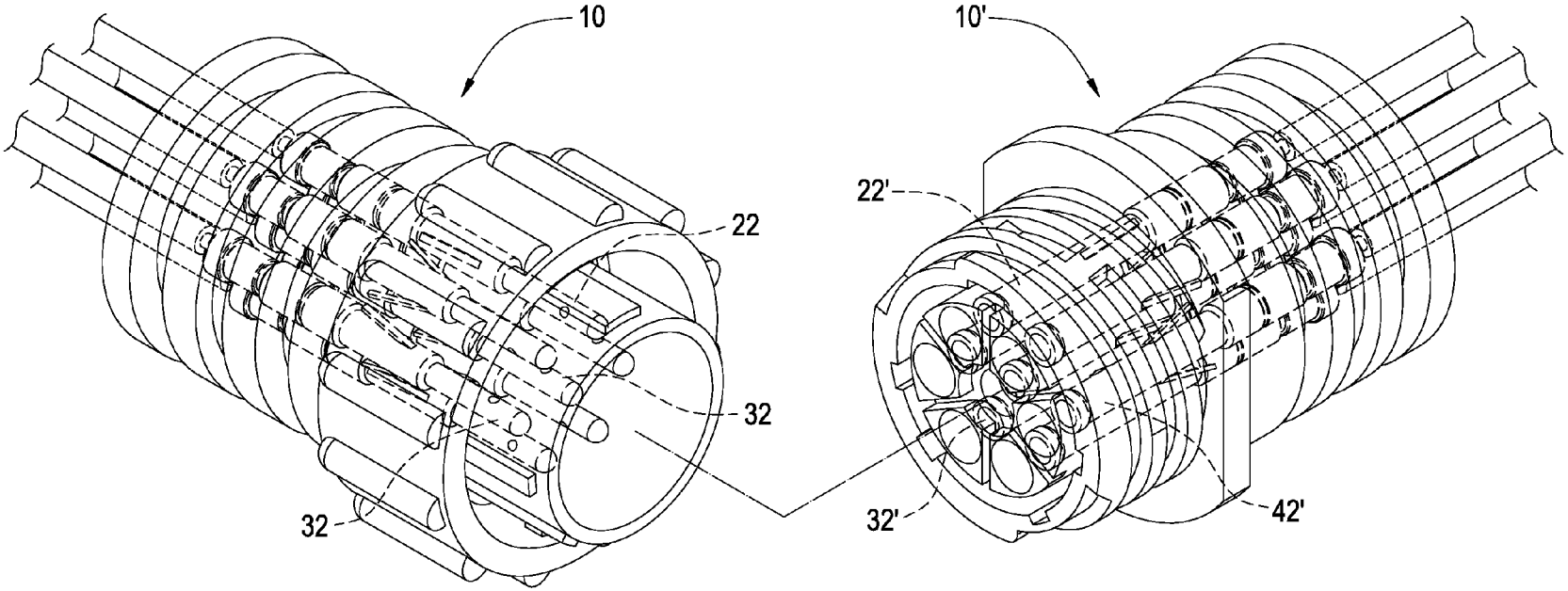
FIG. 6 is a schematic view of an application of a cable installation assembly in accordance with the present invention.

With reference to FIGS. 4 and 5 for a cable installation assembly in accordance with another preferred embodiment of the present invention, the assembly also includes a docking connector 10' coupled to the connector 10, and the major difference between this cable installation assembly from that of the previous preferred embodiment resides on that each power terminal 22' is a female connector plugged and electrically conducted with each power terminal 22; the grounding terminal 32' is also a female connector plugged and electrically conducted with the grounding terminal 32; and the signal terminal 42' is also a female connector plugged and electrically conducted with the signal terminal 42. The power terminal 22', grounding terminal 32' and signal terminal 42' are installed into each corresponding slot in the same way as the previous preferred embodiment, With reference to FIG. 6 for an application of a cable installation assembly of the present invention, the connector 10 is plugged precisely into the docking connector 10' and each power terminal 22, 22', and each grounding terminal 32, 32' and each signal terminal 42, 42' are plugged with one another, and then the knob 12 is turned to engage with a threaded section of the docking connector 10', and an electric power is turned on to conduct each of the terminals electrically.

In summation of the description above, the cable installation assembly of the present invention can achieve the expected effects and overcome the drawbacks of the prior art. The invention complies with the patent application requirements, and is thus duly filed for patent application.

While the invention has been described by means of specific embodiments, numerous modifications and variations could be made thereto by those skilled in the art without departing from the scope and spirit of the invention set forth in the claims.

What is claimed is:

1. A cable installation assembly, comprising:

a connector, having a base, and a plurality of terminal containing grooves formed in the base and arranged with an interval apart and adjacent to each other;

four power wires, each including a power core and a power terminal electrically coupled to the power core, and each power terminal being plugged into the terminal containing groove, wherein the four power wires including two fire wires and two ground wires, and each fire wire is separated from each ground wire and not arranged adjacent to each other;

a ground wire, including a grounding core and a grounding terminal electrically coupled to the grounding core, and the grounding terminal being plugged into the terminal containing groove; and two signal wires, each including a signal core and a signal terminal electrically coupled to the signal core, and the two signal terminals being plugged into the terminal containing grooves respectively.

2. The cable installation assembly of claim 1, wherein the terminal containing grooves include a first slot formed at the middle, and a plurality of slots formed into a circular shape by using the first slot as the center of the circular shape.

3. The cable installation assembly of claim 2, wherein the grounding terminal is installed in the first slot.

4. The cable installation assembly of claim 1, wherein the terminal containing grooves include a first slot formed at the middle, and a second slot to a seventh slot formed into a circular shape by using the first slot as the center of the circular shape.

5. The cable installation assembly of claim 4, wherein the grounding terminal is installed in the first slot, and one of the signal terminals is installed in the third slot, and the other one of the signal terminal is installed in the sixth slot.

6. The cable installation assembly of claim 4, wherein the grounding terminal is installed in the sixth slot, and one of the signal terminals is installed in the fifth slot, and the other one of the signal terminals is installed in the seventh slot.

7. The cable installation assembly of claim 1, wherein each power terminal, the grounding terminal and the two signal terminals are male connectors respectively.

8. The cable installation assembly of claim 1, wherein each power terminal, the grounding terminal and the two signal terminals are female connectors respectively.

9. The cable installation assembly of claim 1, wherein each power wire further includes an insulation layer covered onto an external surface of each power core.

10. The cable installation assembly of claim 1, wherein the ground wire further includes an insulation layer covered onto an external surface of the grounding core.

11. The cable installation assembly of claim 1, wherein any one of the signal wires further includes an insulation layer covered onto an external surface of any one of the signal cores.

* * * * *